US007921795B2

(12) United States Patent
Imlach et al.

(10) Patent No.: US 7,921,795 B2
(45) Date of Patent: Apr. 12, 2011

(54) BUOYANCY CONTROL SYSTEMS AND METHODS

(75) Inventors: Joseph Imlach, Anchorage, AK (US); Paul J. Farley, Sequim, WA (US); Tracy D. DeVoll, Wasilla, AK (US)

(73) Assignee: Alaska Native Technologies, LLC, Anchorage, AK (US)

( * ) Notice: Subject to any disclaimer, the term of this patent is extended or adjusted under 35 U.S.C. 154(b) by 134 days.

(21) Appl. No.: 12/345,182

(22) Filed: Dec. 29, 2008

(65) Prior Publication Data

US 2009/0178603 A1 Jul. 16, 2009

Related U.S. Application Data

(60) Provisional application No. 61/009,364, filed on Dec. 27, 2007.

(51) Int. Cl.
*B63G 8/14* (2006.01)

(52) U.S. Cl. ..... 114/331

(58) Field of Classification Search ..... 114/312, 114/313, 321, 326, 330–333
See application file for complete search history.

(56) References Cited

U.S. PATENT DOCUMENTS

| | | | | |
|---|---|---|---|---|
| 4,076,464 | A * | 2/1978 | Pinney | 417/332 |
| 4,898,288 | A * | 2/1990 | Erdbrink | 212/308 |
| 6,142,092 | A | 11/2000 | Coupland | |
| 6,371,041 | B1 * | 4/2002 | Ness | 114/333 |

OTHER PUBLICATIONS

Stommel, "The Slocum Mission", Oceanography, Apr. 1989, pp. 22-25.
Davis et al., "The Autonomous Lagrangian Circulation Explorer (ALACE)", Journal of Atmospheric and Oceanic Technology, vol. 9, 1992, pp. 264-285.
Eriksen et al., "Seaglider: A Long-Range Autonomous Underwater Vehicle for Oceanographic Research", IEEE Journal of Oceanic Engineering, vol. 26, No. 4, Oct. 2001, pp. 424-436.
Sherman et al., "The Autonomous Underwater Glider 'Spray'", IEEE Journal of Oceanic Engineering, vol. 26, No. 4, Oct. 2001, pp. 437-446.
Webb et al., "SLOCUM: An Underwater Glider Propelled by Environmental Energy", IEEE Journal of Oceanic Engineering, vol. 26, No. 4, Oct. 2001, pp. 447-452.

* cited by examiner

*Primary Examiner* — Daniel V Venne
(74) *Attorney, Agent, or Firm* — Michael R. Schacht; Schacht Law Office, Inc.

(57) ABSTRACT

A buoyancy control system for a submersible object submerged in an ambient fluid, comprising a piston housing, a piston member, a pump, control fluid, and working fluid. The piston housing is supported by the submersible object. The piston member defines a piston portion and a shaft portion. The piston member is supported within the piston housing such that the piston portion and the piston housing define a control chamber and an ambient chamber and the shaft portion and the piston housing define a working chamber. The pump is operatively connected to the working chamber. The control fluid is arranged within the control chamber. At least a portion of the working fluid is arranged within the working chamber. Operation of the pump displaces working fluid within the working chamber to displace the piston member to alter a volume of the control chamber.

20 Claims, 3 Drawing Sheets

BUOYANCY CONTROL SYSTEMS AND METHODS

RELATED APPLICATIONS

This application claims benefit of U.S. Provisional Application Ser. No. 61/009,364, which was filed on Dec. 27, 2007. The contents of the related specification listed above are incorporated herein by reference.

TECHNICAL FIELD

The present invention relates to systems and methods for controlling the buoyancy of waterborne objects and, more specifically, to buoyancy control systems and methods for controlling the buoyancy of devices and vehicles that are capable of being submersed.

BACKGROUND OF THE INVENTION

The ability to control the buoyancy of an object is desirable in many applications. For example, in the field of unmanned underwater vehicles (UUVs), it is often desirable to adjust the buoyancy of the vehicle to stabilize it in the water column (hover) or to make the vehicle rise or sink within the column.

Accordingly, many waterborne objects are provided with a buoyancy control mechanism, or "buoyancy engine", that allows active control of the buoyancy of the object. Active buoyancy control allows the buoyancy of an object to be adjusted as necessary for a desired maneuver or to accommodate unknown or changing environmental conditions. For example, the buoyancy of the object may be adjusted to bring a submerged object to the surface so that it can communicate via radio, then return the object to a submerged condition. As another example, the buoyancy of an object might be adjusted to accommodate variations in density of the surrounding water due to changes in temperature and/or salinity.

The present application is generally applicable to any type of waterborne object for which buoyancy control is desirable. Examples of waterborne objects that employ or may employ buoyancy control include: floats, buoys, weaponry (torpedoes), and manned and unmanned powered submarines. The present invention is, however, of particular significance when applied to the class of UUV's referred to as "gliders". A glider is propelled through the water completely by changes to the buoyancy of the vehicle. The present invention will be described in detail below in the context of a glider.

For UUVs that are powered by batteries or other fixed energy storage mechanisms, one design goal is to optimize the energy efficiency of all onboard systems. The buoyancy control engine can be a major consumer of stored energy, so an effective buoyancy control engine should be energy efficient. The buoyancy engine should also be reliable, low weight, and easily maintainable.

Conventional gliders have a buoyancy engine that effectively changes the volume of the glider. One class of conventional gliders (e.g., the "Seaglider" produced by the University of Washington and the "Spray" produced by Bluefin Robotics) uses hydraulic pumps to transfer hydraulic fluid from an internal bladder to an external bladder. Yet another class of gliders (e.g., the "Slocum Thermal" produced by Webb Research) harvests the thermal energy of the ocean to move a transfer fluid between an internal bladder and an external bladder. The buoyancy engines employed by these gliders will be referred to as "internal bladder/external bladder" buoyancy control engines.

Another class of gliders (e.g., the "Slocum Electric" produced by Webb Research) uses a motor to drive a ball screw. The ball screw in turn drives a piston inside a rolling diaphragm. The diaphragm/piston combination displaces water when extended and ingests water when retracted. This type of buoyancy engine will be referred to as "ball screw/piston" type buoyancy control engines.

A related class of UUVs includes floats or buoys (e.g., The "ALACE" (Autonomous Lagrangian Circulation Explorer) floats). In the case of floats or buoys, the purpose of the buoyancy control system is typically to maintain neutral buoyancy for a period of time at a predetermined depth and then adjust the buoyancy to cause the vessel to surface and communicate data. After the communication process is completed, the buoyancy of the vessel is again adjusted to cause the float or buoy to descend and then become neutrally buoyant at the predetermined depth. Such floats or buoys also use an "internal bladder/external bladder" configuration to control buoyancy.

One problem with the "internal bladder/external bladder" class of buoyancy engine is that a large amount of fluid is required to adjust the buoyancy of the device. Because the fluid is transferred into a bladder that directly displaces the water, there is a one to one ratio between required fluid and potential displacement (i.e. one liter of fluid is required to displace one liter of water). The ratio of required fluid to potential displacement limits the net buoyancy of the vehicle. In the context of gliders, this limitation on net buoyancy limits the speed of the glider and also the ability of the glider to adjust its buoyancy in response to changes in salinity and temperature.

Another disadvantage of the "internal bladder/external bladder" buoyancy engine is that the hydraulic pumps used in these designs are typically optimized for maximum efficiency at a significantly higher pressure than the operational pressure of the device. In particular, the hydraulic pump does not operate at maximum efficiency at the maximum operational depth of the vessel, and the hydraulic pump is even less efficient at shallower depths.

For example, the "Seaglider" glider developed by the University of Washington employs the Hydro LeDuc model PB32.5 pump. This pump has a maximum total efficiency (combined mechanical and volumetric efficiency) that peaks at approximately 34 MPa (~5000 psi), while the pressure at the Seaglider's maximum operational depth of approximately 1,000 m yields a pressure of approximately 10 MPa (~1500 psi). The efficiency of the buoyancy engine of the "Seaglider" glider is less than 15% at 200 m operation and only 40% at 1000 m operation.

The "ball screw/piston" type of buoyancy engine similarly suffers from low efficiency. Small DC motors are typically designed to run at high speeds (e.g. 5,000-10,000 rpm). While these motors can be highly efficient (typically 80-90%) at these relatively high operational speeds, the speed of such motors needs to be significantly reduced to drive a ball screw assembly of a "ball screw/piston" type buoyancy engine. A reduction gear is thus typically used to reduce the speed of the motor; a reduction gear is usually about 70% efficient, giving a combined efficiency in the range of 56-63%. In addition, the ball screw assembly itself typically operates at only about 95% efficiency, thereby reducing the maximum potential efficiency of this system to a range of 50-60%. The "Slocum Electric" device produced by Webb Research, which uses a ball screw/piston type buoyancy engine, has a published buoyancy engine efficiency of about 50%, which is at the low end of the theoretical range of efficiencies for the "ball screw/piston" type of buoyancy engine.

It is therefore an object of the current invention to provide buoyancy control systems and methods for a submersible vessel having improved efficiency over the entire operational depth range of the vessel. An additional object of the current invention is to provide buoyancy control systems and methods that are reliable and easy to manufacture and maintain.

SUMMARY

The present invention may be embodied as a buoyancy control system for a submersible object submerged in an ambient fluid, comprising a piston housing, a piston member, a pump, control fluid, and working fluid. The piston housing is supported by the submersible object. The piston member defines a piston portion and a shaft portion. The piston member is supported within the piston housing such that the piston portion and the piston housing define a control chamber and an ambient chamber and the shaft portion and the piston housing define a working chamber. The pump is operatively connected to the working chamber. The control fluid is arranged within the control chamber. At least a portion of the working fluid is arranged within the working chamber. Operation of the pump displaces working fluid within the working chamber to displace the piston member to alter a volume of the control chamber.

The present invention may also be embodied as a method of controlling the buoyancy of a submersible object submerged in an ambient fluid comprising the following steps. A piston housing is supported with respect to the submersible object. A piston member defining a piston portion and a shaft portion is supported within the piston housing such that the piston portion and the piston housing define a control chamber and an ambient chamber and the shaft portion and the piston housing define a working chamber. A pump is operatively connected to the working chamber. Control fluid is arranged within the control chamber. At least a portion of a working fluid is arranged within the working chamber. The pump is operated to displace working fluid within the working chamber, thereby displacing the piston member to alter a volume of the control chamber.

The present invention may also be embodied as a buoyancy controlled object to be submerged in an ambient fluid. In this form, the invention may comprise a hull assembly; a piston housing rigidly connected to the hull assembly; a piston member, a pump, an accumulator, a valve, control fluid, and working fluid. The piston member defines a piston portion and a shaft portion. The piston member is supported within the piston housing such that the piston portion and the piston housing define a control chamber and an ambient chamber, where the hull allows ambient fluid to enter and exit the ambient chamber, and the shaft portion and the piston housing define a working chamber. The pump is operatively connected to the working chamber. The accumulator is operatively connected to the working chamber. The valve is also operatively connected to the working chamber. The control fluid is arranged within the control chamber. At least a portion of the working fluid is arranged within the working chamber and at least a portion of the working fluid is arranged in the accumulator. Operation of the pump displaces working fluid within the working chamber to displace the piston member to alter a volume of the control chamber. Operation of the valve controls the flow of fluid into and out of the working chamber.

The present invention may be embodied in other configurations as will become apparent from the following discussion of examples of the present invention.

DETAILED DESCRIPTION OF THE INVENTION

Figure 1:
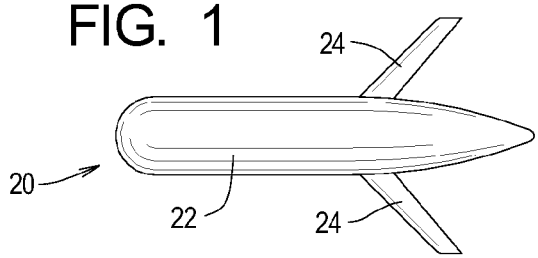
FIG. 1 is a top plan view of an example glider that may incorporate a buoyancy control system of the present invention.
Figure 2:
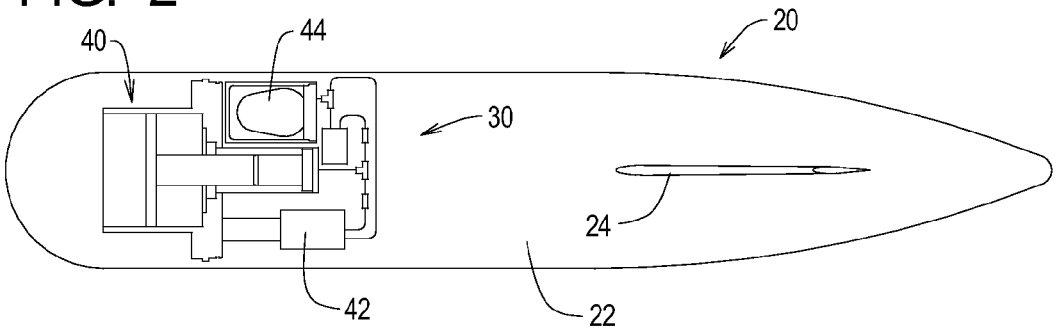
FIGS. 2-4 are side elevation, partial schematic views illustrating the operation of the example glider of FIG. 1.
Figure 3:
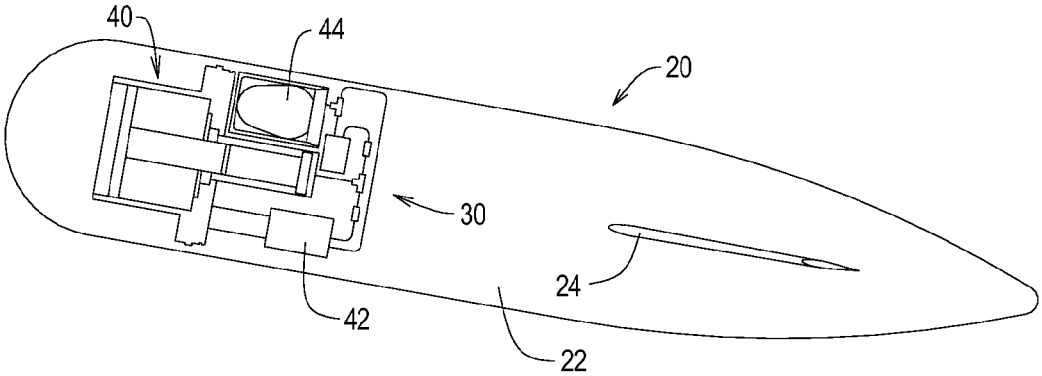

Referring initially to FIG. 1 of the drawing, depicted therein is an example waterborne vessel in the form of a glider 20. The example glider 20 is generally conventional in that it comprises a hull assembly 22 and one or more fins and/or wings 24. FIGS. 2-3 illustrate that the example glider 20 further comprises a buoyancy control system 30 arranged within the hull assembly 22.

Figure 5:
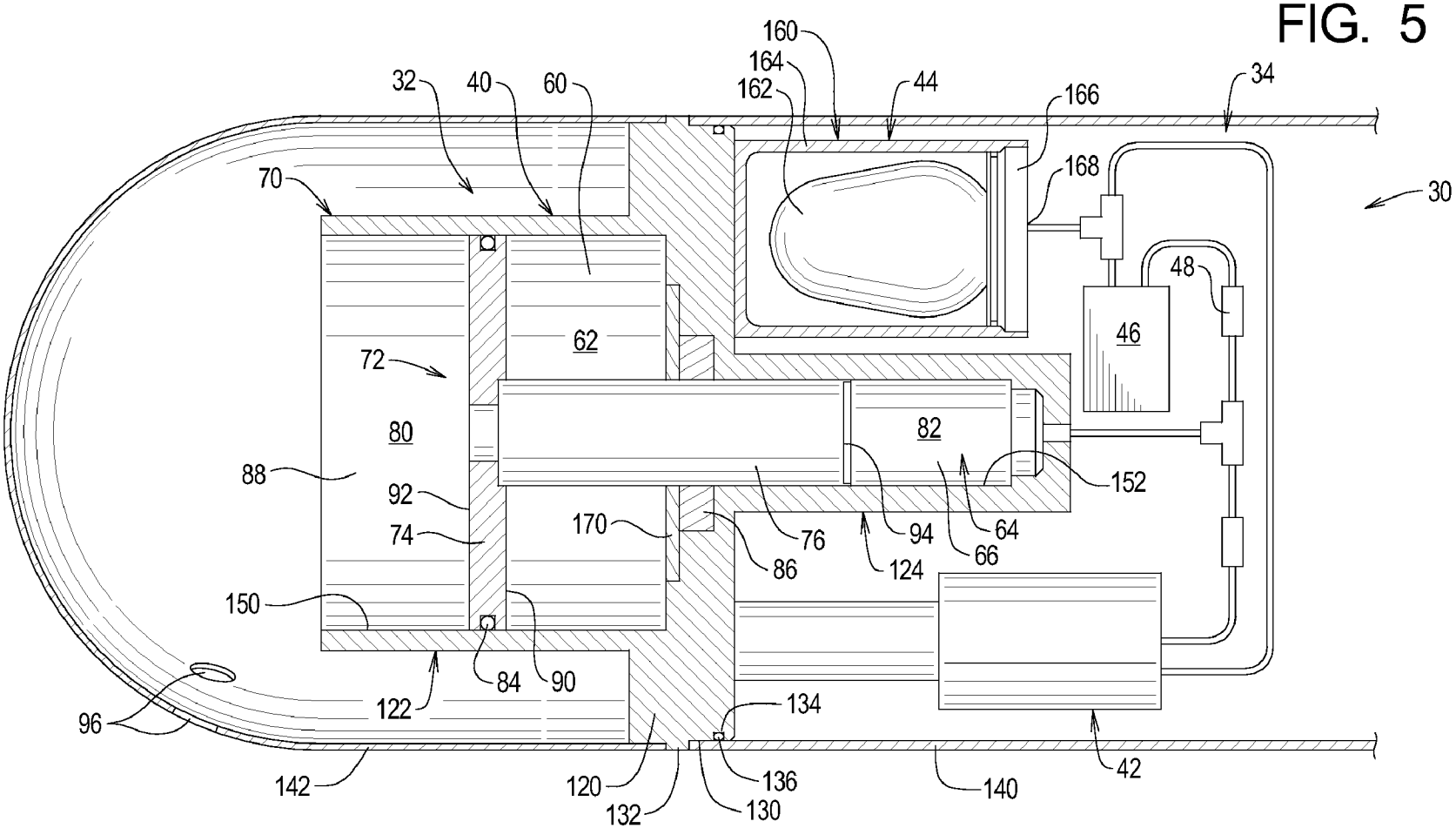
FIG. 5 is a somewhat schematic view side elevation, cross-sectional view depicting details of the buoyancy control system of the example glider of FIG. 1.
Figure 6:
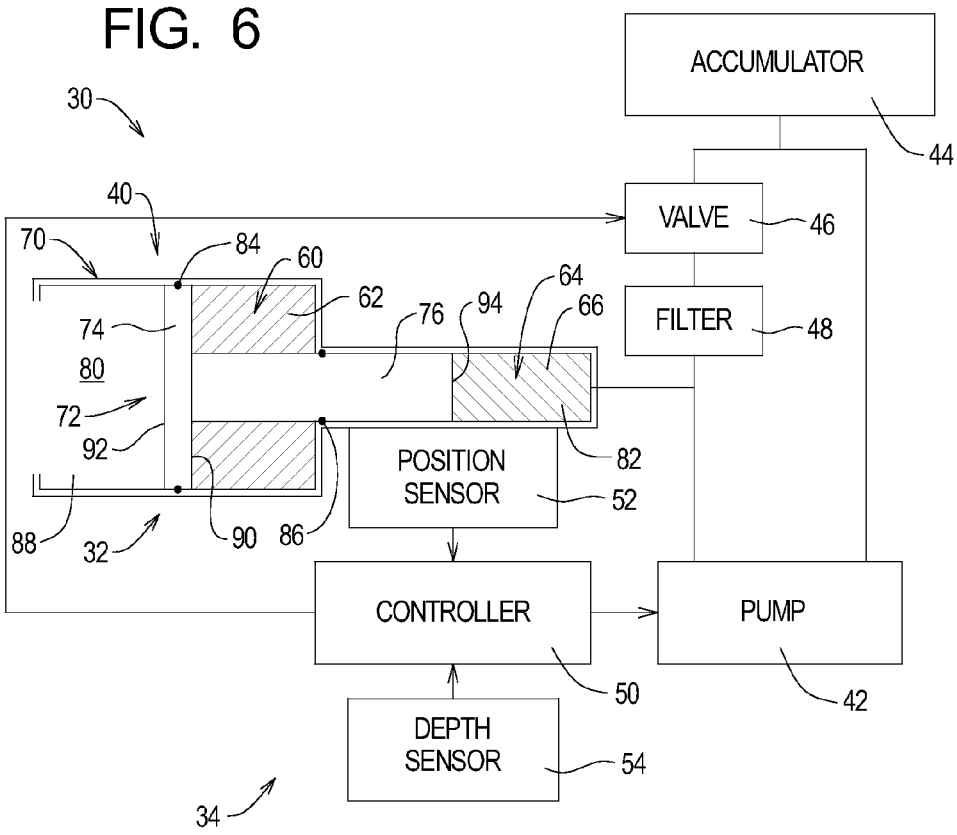
FIG. 6 is a schematic block diagram illustrating an electrical portion of the example buoyancy control system of the glider depicted in FIG. 1.

The buoyancy control system 30 is depicted in further detail in FIGS. 5-7 of the drawing. In particular, FIG. 5 illustrates details of a mechanical portion 32 of the buoyancy control system 30, while FIG. 6 schematically illustrates both the mechanical portion 32 and a control portion 34 of the buoyancy control system 30.

Referring initially to FIG. 6 of the drawing, it can be seen that the example mechanical portion 32 comprises a piston assembly 40, a pump assembly 42, an accumulator assembly 44, a valve assembly 46, and a filter 48. FIG. 6 further shows that the example control portion 34 comprises a controller 50, a position sensor 52, and a depth sensor 54. The piston assembly 40 defines a control chamber 60 containing a control fluid 62 and a working chamber 64 comprising a working fluid 66. The control fluid 62 is compressible, while the working fluid 66 is incompressible.

In use, the controller 50 operates the pump assembly 42 and the valve assembly 46 to introduce the working fluid 66 into and withdraw working fluid 66 from the working chamber 64 to change a configuration of the piston assembly 40. In particular, the controller 50 controls the pump assembly 42 and the valve assembly 46 to cause working fluid to flow into and out of the working chamber 64. As the working fluid flows into and out of the working chamber 64, the configuration of the piston assembly 40 is changed.

As the configuration of the piston assembly 40 changes, the volume of the control chamber 60 changes. Increasing the volume of the control chamber 60 increases the buoyancy of the buoyancy control system 30. Decreasing the volume of the control chamber 60 decreases the buoyancy of the buoyancy control system 30. Accordingly, as the configuration of the piston assembly 40 changes, the buoyancy of the buoyancy control system 30 changes.

Figure 4:
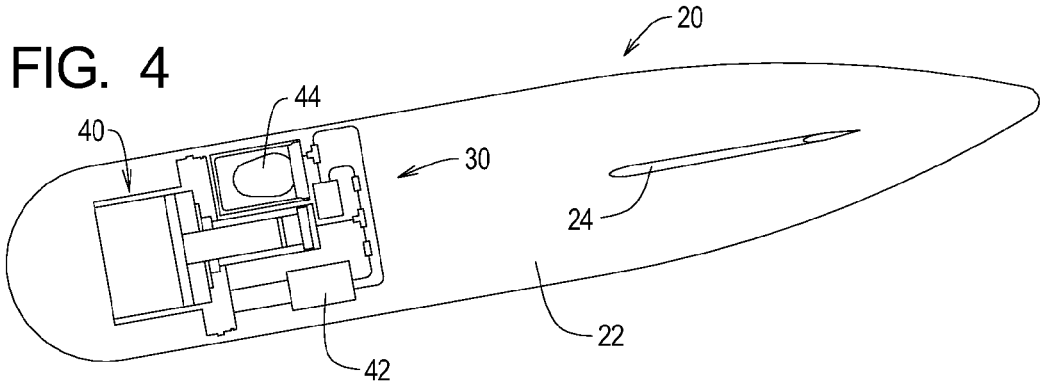

Referring for a moment back to FIGS. 2-4, it can be seen that, as the buoyancy of the buoyancy control system 30 changes, the attitude of the glider 20 changes. Ideally, the buoyancy of the glider 20 (without the buoyancy control system 30 or with the buoyancy control system 30 in a neutral configuration) is substantially constant, at or near neutral, and distributed evenly so that the attitude of the glider 20 is substantially horizontal. Accordingly, when the buoyancy of the buoyancy control system 30 is substantially neutral, the attitude of the glider 20 is substantially horizontal (FIG. 2). When the buoyancy of the buoyancy control system 30 is positive, the axis of the glider 20 is upwardly canted (FIG. 3). And when the buoyancy of the buoyancy control system 30 is negative, the axis of the glider 20 is downwardly canted (FIG. 3).

The buoyancy control system 30 thus allows the example glider 20 to be maneuvered through the water in the manner of a conventional glider. The buoyancy control system 30 may be used to control the buoyancy of any vessel that is designed to function underwater, whether designed to move without propulsion (e.g., a glider), designed to move with propulsion (e.g., a torpedo), or designed to move up and down within a substantially static water column (e.g., a float or buoy).

With the foregoing general understanding of the principles of the present invention in mind, the construction and operation of the example buoyancy control system 30 will now be described in further detail.

As shown in both FIGS. 5 and 6 of the drawing, the example piston assembly 40 comprises a piston housing 70 and a piston member 72. The piston member 72 comprises a piston portion 74 and a shaft portion 76. The piston member 72 is arranged within the piston housing 70 to define the control chamber 60 and the working chamber 64.

In particular, the piston housing 70 defines a low pressure cavity 80 and a high pressure cavity 82. Further, a first seal member 84 is mounted on the piston portion 74 of the piston member 72, and a second seal member 86 is mounted on the piston housing 70. The piston portion 74 thus divides the low pressure cavity 80 into an ambient chamber 88 and the control chamber 60. The shaft portion 76 lies within the high pressure cavity 82, and the portion of the high pressure cavity 82 not occupied by the shaft portion 76 is the working chamber 64. The first seal member 84 prevents fluid flow between the control chamber 60 and the ambient chamber 88, while the second seal member 86 prevents fluid flow between the control chamber 60 and the working chamber 64.

The piston portion 74 of the piston member defines a control surface 90 and an ambient surface 92. The shaft portion 76 of the piston member 72 defines a working surface 94. When the working fluid 66 is forced into the working chamber 64, the working fluid 66 acts on the working surface 94 to displace the shaft portion 76 in a first direction. The shaft portion 76 is connected to the piston portion 74 such that, as the shaft portion 76 moves in the first direction, the piston portion 74 also moves in the first direction. As the piston portion 74 moves in the first direction, the volume of the control chamber 60 increases.

When the working fluid 66 is forced out of the working chamber 64, the working fluid 66 acts on the working surface 94 to displace the shaft portion 76 in a second direction opposite the first direction. Because the shaft portion 76 is connected to the piston portion 74, as the shaft portion 76 moves in the second direction, the piston portion 74 also moves in the second direction. As the piston portion 74 moves in the second direction, the volume of the control chamber 60 decreases.

When the volume of the working fluid 66 in the working chamber 64 is held constant, the shaft portion 76 does not move. Because the shaft portion 76 is connected to the piston portion 74, if the shaft portion 76 does not move, the piston portion 74 also does not move. When the piston portion 74 is not moving, the volume of the control chamber 60 does not change.

Accordingly, by forcing working fluid 66 into the working chamber 64, forcing working fluid 66 out of the working chamber 64, and preventing the working fluid 66 from flowing into our out of the working chamber 64, the volume of the control chamber 60 can be increased, decreased, or held constant. Controlling the volume of the control chamber 60 thus allows the buoyancy of the buoyancy control system 30 to be increased, decreased, or held constant.

Referring for a moment back to FIG. 5, it can be seen that holes 96 are formed in the glider hull assembly 22 to allow water to flow into and out of the ambient chamber 88. The ambient chamber 88 is thus in fluid communication with the water surrounding the glider 20. Accordingly, when the volume of the control chamber 60 increases, water is expelled from the glider 20. Conversely, when the volume of the control chamber 60 decreases, water is drawn into the glider 20.

The example controller 50 shown in FIG. 6 generates a pump control signal for turning the pump assembly 42 on or off and a valve control signal for placing the valve assembly 46 in a closed configuration or an open configuration. By operating the pump assembly 42 with the valve assembly 46 in the closed configuration, the working fluid 66 is forced into the working chamber 64 to displace the piston member 72 in the first direction. By turning off the pump assembly 42 with the valve assembly 46 in the closed configuration, the volume of working fluid 66 within the working chamber 64 is held constant.

Accordingly, when the pump assembly 42 is off and the valve assembly 46 is in the open configuration, pressure on the ambient surface 92 of the piston portion 74 forces working fluid out of the working chamber 64 and into the accumulator assembly 44.

Referring now more specifically to FIG. 5, it can be seen that the piston housing 70 comprises a bulkhead portion 120, a low pressure portion 122, and a high pressure portion 124.

The example bulkhead portion 120 defines an annular surface 130 defining a stop flange 132 and a seal groove 134 that receives a seal member 136. FIG. 5 also shows that the hull assembly 22 of the glider 20 comprises a main portion 140 and a nose cone portion 142. The main portion 140 is attached to the annular surface 130 to rigidly connect the main portion 140 to the bulkhead portion 120. The seal member 136 forms a fluid tight seal at the juncture of the bulkhead portion 120 and the main portion 140. The nose cone portion 142 is also attached to the annular surface 130 to rigidly connect the nose cone portion 142 to the bulkhead portion 120.

The example low pressure portion 122 and high pressure portion 124 extend from the bulkhead portion 120 and define the low pressure cavity 80 and high pressure cavity 82, respectively. The example low pressure cavity 80 is defined by a cylindrical inner surface 150 of the low pressure portion 122, while the example high pressure cavity 82 is defined by a cylindrical inner surface 152 of the high pressure portion 124.

The example controller 50 shown in FIG. 6 is or may be a general purpose computing device running a software program. While the functions of the controller 50 can be implemented using dedicated electronics, the use of a general purpose computing device running a software program facilitates the changing of the logic carried out by the control system 34.

As shown in FIG. 6, the controller 50 generates the pump control signal and the valve control signal based on one or more inputs. The controller 50 may function solely based on logic embodied in the software program, may function in response to external commands received through a communications system, or may function based on a combination of software program logic and external commands. The example system 30 operates based on a position sensor signal generated by the position sensor 52 and a depth signal generated by the depth sensor 54. Alternative inputs include an attitude signal generated by an attitude sensor, a salinity signal generated by a salinity sensor, and a temperature signal generated by a thermometer.

The example accumulator assembly 44 will now be described in further detail with reference to FIG. 5. The accumulator assembly 44 comprises an accumulator housing assembly 160 and a pressure bag 162. The accumulator housing assembly 160 comprises a main portion 164 and a cap portion 166. A port 168 formed in the cap portion 166 is operatively connected to the pump assembly 42 and the valve assembly 46 as generally described above.

With the pump assembly 42 and the valve assembly 46 in a first set of configurations, pressurized working fluid 66 flows into the housing assembly 160 through the port 168 to collapse the pressure bag 162. The pressure bag 162 thus allows working fluid 66 to flow into the accumulator 44 under pressure. The stored working fluid 66 is pressurized such that the working fluid 66 is forced out of the accumulator 44 when the pump assembly 42 and the valve assembly 46 are in a second set of configurations.

The accumulator 44 thus functions to store working fluid 66 under pressure for use by the buoyancy control system 30 as described above. The construction and operation of the example accumulator 44 is appropriate for use by the buoyancy control system 30, but any accumulator that functions in a similar manner may be used by a buoyancy control system of the present invention.

FIG. 5 further illustrates that the example second seal member 86 is mounted on or within the piston housing 70 by a seal retaining member 170. The second seal member 86 and the seal retaining member are disk-shaped members through which the shaft portion 76 of the piston member 72 extends. The example second seal member 86 helps to support the piston member 72 for movement as shown in FIGS. 2-4, establishes a fluid tight seal between the control chamber 60 and the working chamber 64, and allows easy assembly and maintenance of the piston assembly 40.

What is claimed is:

1. A buoyancy control system for a submersible object submerged in an ambient fluid, comprising:
- a piston housing supported by the submersible object;
- a piston member defining a piston portion and a shaft portion, where the piston member is supported within the piston housing such that
  - the piston portion and the piston housing define a control chamber and an ambient chamber, and
  - the shaft portion and the piston housing define a working chamber;
- a pump operatively connected to the working chamber;
- control fluid arranged within the control chamber; and
- working fluid, where at least a portion of the working fluid is arranged within the working chamber; whereby
- operation of the pump displaces working fluid within the working chamber to displace the piston member to alter a volume of the control fluid arranged within the control chamber.

2. A buoyancy control system as recited in claim 1, further comprising an accumulator operatively connected to the working chamber, where at least a portion of the working fluid is arranged within the accumulator.

3. A buoyancy control system as recited in claim 1, further comprising a valve operatively connected to the working chamber, where the valve controls the flow of fluid into and out of the working chamber.

4. A buoyancy control system as recited in claim 2, further comprising a valve operatively connected to the working chamber and to the accumulator, where the valve controls the flow of fluid into and out of the working chamber.

5. A buoyancy control system as recited in claim 1, further comprising a control system for operating the pump and the valve.

6. A buoyancy control system as recited in claim 1, in which the control system comprises a position sensor for sensing a position of the piston member relative to the piston housing.

7. A buoyancy control system as recited in claim 1, in which the control system comprises a depth sensor for sensing a depth of the submersible object.

8. A buoyancy control system as recited in claim 6, in which the control system further comprises a depth sensor for sensing a depth of the submersible object.

9. A buoyancy control system as recited in claim 1, further comprising:
- a first seal arranged to inhibit flow of fluid between the piston portion and the piston housing; and
- a second seal arranged to inhibit flow of fluid between the shaft portion and the piston housing.

10. A buoyancy control system as recited in claim 9, in which the second seal is arranged to inhibit flow of fluid between the control chamber and the working chamber.

11. A buoyancy control system as recited in claim 1, in which the piston portion defines:
- a control surface that acts on the control fluid; and
- an ambient surface that acts on the ambient fluid.

12. A buoyancy control system as recited in claim 1, further comprising a filter arranged to filter the working fluid.

13. A method of controlling the buoyancy of a submersible object submerged in an ambient fluid, comprising the steps of:
- securing a piston housing to the submersible object;
- providing a piston member defining a piston portion and a shaft portion,
- supporting the piston member within the piston housing such that
  - the piston portion and the piston housing define a control chamber and an ambient chamber, and
  - the shaft portion and the piston housing define a working chamber; and
- operatively connecting a pump to the working chamber;
- arranging control fluid within the control chamber;
- providing working fluid;
- arranging at least a portion of the working fluid is arranged within the working chamber; whereby
- operating the pump to displace working fluid within the working chamber, thereby displacing the piston member to alter a volume of the control fluid arranged within the control chamber.

14. A method as recited in claim 13, further comprising the steps of:
- operatively connecting an accumulator to the working chamber; and
- arranging at least a portion of the working fluid within the accumulator.

15. A method as recited in claim 13, further comprising the steps of:
- operatively connecting a valve to the working chamber;
- operating the valve to control the flow of fluid into and out of the working chamber.

16. A method as recited in claim 15, in which the step of operating the valve comprises the step of sensing a position of the piston member relative to the piston housing.

17. A method as recited in claim 16, in which the step of operating the valve comprises the step of sensing a depth of the submersible object.

18. A buoyancy controlled object to be submerged in an ambient fluid, comprising:

a hull assembly;

a piston housing rigidly connected to the hull assembly;

a piston member defining a piston portion and a shaft portion, where the piston member is supported within the piston housing such that the piston portion and the piston housing define a control chamber and an ambient chamber, and the shaft portion and the piston housing define a working chamber;

a pump operatively connected to the working chamber;

an accumulator operatively connected to the working chamber;

a valve operatively connected to the working chamber;

control fluid arranged within the control chamber; and working fluid, where at least a portion of the working fluid is arranged within the working chamber and at least a portion of the working fluid is arranged in the accumulator; whereby operation of the pump displaces working fluid within the working chamber to displace the piston member to alter a volume of the control fluid arranged within the control chamber; and operation of the valve controls the flow of working fluid into and out of the working chamber.

19. A buoyancy control system as recited in claim 18, further comprising a control system for operating the pump and the valve based on at least one of:

a position of the piston member relative to the piston housing; and a depth of the submersible object.

20. A buoyancy control system as recited in claim 19, further comprising:

a first seal arranged to inhibit flow of fluid between the piston portion and the piston housing; and a second seal arranged to inhibit flow of fluid between the control chamber and the working chamber between the shaft portion and the piston housing.

* * * * *